US006568915B2

(12) United States Patent
Yokomachi et al.

(10) Patent No.: US 6,568,915 B2
(45) Date of Patent: May 27, 2003

(54) GAS PASSAGE STRUCTURE WITH IMPROVED SEAL MEMBERS IN A COMPRESSOR

(75) Inventors: Naoya Yokomachi, Kariya (JP); Tatsuya Koide, Kariya (JP); Toshiro Fujii, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/965,986

(22) Filed: Sep. 28, 2001

(65) Prior Publication Data

US 2002/0041810 A1 Apr. 11, 2002

(30) Foreign Application Priority Data

Oct. 5, 2000 (JP) ..... 2000-306180

(51) Int. Cl.[7] ..... F04B 1/26; E03B 17/04; F16K 31/02

(52) U.S. Cl. ..... 417/222.2; 137/884; 251/129.02

(58) Field of Search ..... 417/222.2, 269; 137/884; 251/129.02

(56) References Cited

U.S. PATENT DOCUMENTS 2,911,183 A * 11/1959 Mathews et al. ..... 251/129.02

6,149,397 A * 11/2000 Mizutani et al. ..... 417/222.2

FOREIGN PATENT DOCUMENTS

| | | |
|---|---|---|
| JP | A-6-336978 | 12/1994 |
| JP | A-9-209960 | 8/1997 |

* cited by examiner

*Primary Examiner*—Charles G. Freay
*Assistant Examiner*—Michael K. Gray
(74) *Attorney, Agent, or Firm*—Woodcock Washburn LLP

(57) ABSTRACT

The number of seal members relating to a gas flow control valve can be reduced. A displacement control valve 25 is attached to a fixed coupling surface 193 on the outer wall surface of a rear housing 19. A gasket 45 is interposed between end surfaces 362 and 414 of the displacement control valve 25 side and a coupling surface 193. A sealing elastic layer 452 of the gasket 45 is in close contact with the end surfaces 362 and 414, and a sealing elastic layer 453 is in close contact with the coupling surface 193. A pressure supply passage 30 and a gas passage 413 are communicated with each other via a communication port 454 on the gasket 45. A pressure supply passage 31 is communicated with an insertion recess 33 that is communicated with a valve port 431.

5 Claims, 7 Drawing Sheets

GAS PASSAGE STRUCTURE WITH IMPROVED SEAL MEMBERS IN A COMPRESSOR

BACKGROUND OF THE INVENTION

1. Field of the Invention

The present invention relates to a gas passage structure in a compressor in which a compression operating body is moved by the rotation of a rotating shaft, a gas flow control valve, that controls the gas flow in a gas passage within a main body of the compressor that compresses and discharges gas by means of the action of the compression operating body, is provided, and the gas flow control valve is attached to the main body of the compressor so as to oppose a gas passage forming body that forms the gas passage.

2. Description of the Related Art

In a compressor of variable displacement type such as that disclosed in Japanese Unexamined Patent Publication (Kokai) No. 6-336978, refrigerant is supplied from a discharge chamber to a crank chamber and, at the same time, is discharged from the crank chamber to a suction chamber to control the pressure in the crank chamber, and displacement control is carried out in a manner that the inclination of a swash plate is increased by a pressure drop in the crank chamber and decreased by a pressure increase in the crank chamber. The refrigerant in the discharge chamber is sent to the crank chamber through a supply passage and the refrigerant in the crank chamber flows into the suction chamber through a bleed passage. A control valve is interposed in the supply passage. The control valve controls the flow rate of the refrigerant sent from the discharge chamber to the crank chamber.

The control valve is attached to a rear housing that forms the discharge chamber and the suction chamber, and a part of the control valve is exposed on the outside of the compressor. In this structure, in which part of the control valve is exposed, it is necessary to prevent the refrigerant in the compressor from leaking out, through the coupling surface between the control valve and the rear housing, to the outer side of the compressor. It is also necessary to prevent the supply passage that runs from the control valve to the discharge chamber and the supply passage that runs from the control valve to the crank chamber from communicating with each other through the coupling surface. Therefore, plural ring shaped seal members are interposed between the outer surface of the control valve and the rear housing.

However, the structure, in which plural seal members of ring shape are interposed between the outer surface of the control valve and the rear housing, makes the work of assembling a compressor equipped with the control valve intricate. Moreover, if the number of seal members is increased, the cost of the compressor is also increased.

The seal members described above are made of rubber and a seal member, deformed elastically between the outer surface of the control valve and the rear housing, prevents the refrigerant from leaking. When carbon dioxide is used as refrigerant, it is used at a pressure higher than that when a chlorofluorocarbon-type refrigerant is used, and carbon dioxide at high pressure can easily permeate the inner side of the rubber seal member. If the carbon dioxide at high pressure permeates the inner side of the rubber seal member while the compressor is in operation and the pressure of the carbon dioxide drops when the operation of the compressor is terminated, the carbon dioxide that has permeated the inner side of the seal member expands. A foaming phenomenon, in which the carbon dioxide in the inner side of the seal member expands, damages the rubber seal member. The damage to the seal member causes the sealing performance of the seal member to degrade. Therefore, malfunctions, in that part of the refrigerant to be sent to the crank chamber leaks out of the compressor or that the refrigerant is sent to the crank chamber excessively, are caused. If the refrigerant leaks out of the compressor, the quantity of the refrigerant runs low and the efficiency of the compressor is degraded. If the refrigerant is sent to the crank chamber excessively, a stable displacement control is impeded.

SUMMARY OF THE INVENTION

The first object of the present invention is to reduce the number of the seal members relating to the gas flow control valve that controls the gas flow in the gas passage within the main body of the compressor. The second object of the present invention is to prevent an abnormal gas flow due to the damage of the seal members.

Therefore, the present invention applies to a compressor, in which a gas transfer body is moved by the rotation of the rotating shaft, gases are transferred by the action of the gas transfer body, and a gas flow control valve that controls the gas flow in the gas passage within the compressor is provided. In the first aspect of the present invention, a seal means that is formed by one seal member or plural seal members is interposed between installing surfaces, opposing the gas flow control valve, on the gas passage forming body side, and installing surfaces, opposing the gas passage forming body, on the gas flow control valve side, a first gas passage that passes within the gas passage forming body is connected to an inner valve port of the gas flow control valve, a second gas passage that passes within the gas passage forming body is connected to the valve port of the gas flow control valve so that the second gas passage is communicated with the first gas passage via the valve port, the first gas passage and the second gas passage are penetrated through each of the opposing installing surfaces within the surrounded area on each of the opposing installing surfaces surrounded by seal operating portions of the one or plural seal members, and at least either the first gas passage or the second gas passage penetrates through the seal operating portions of the one or plural seal members.

Both the first gas passage and the second gas passage are prevented from communicating with the outer side of the compressor via the opposing installing surfaces by the seal operating portions of the one or plural seal members. Therefore, the gas in the first gas passage and that in the second passage do not leak out of the compressor. The first gas passage and the second gas passage are prevented from communication with each other via the opposing installing surfaces by the seal operating portions of the one or plural seal members. Therefore, the first gas passage and the second gas passage are communicated with each other only via the valve port. In the structure in which at least either the first gas passage or the second gas passage penetrates through the seal member, the prevention of communication between the first gas passage and the outside of the compressor, between the second gas passage and the outside of the compressor, and between the first gas passage and the second gas passage can be achieved by the single seal member.

In another embodiment of the present invention, the compressor of the first embodiment of the present invention is modified into a compressor of a variable displacement type, comprising a swash plate contained in a control pressure chamber so that integral rotation with the rotating shaft is allowed and the inclination angle, with respect to the rotating shaft, can be varied, and plural pistons, which are arranged around the rotating shaft and perform reciprocating motion in accordance with the inclination angle of the swash plate, wherein: gas is supplied from a discharge pressure area to the control pressure chamber via a pressure supply passage; gas is released from the control pressure chamber to a suction pressure area via a pressure release passage to control the pressure in the control pressure chamber; the inclination angle of the swash plate is increased by a pressure drop in the control pressure chamber and the inclination angle of the swash plate is decreased by a pressure increase in the control pressure chamber; and the gas flow control valve controls the gas flow in the pressure supply passage or the gas flow in the pressure release passage.

The present invention can be appropriately applied to the gas flow control valve which controls the displacement of the compressor of variable displacement type.

The present invention may be more fully understood from the description of the preferred embodiments of the invention set forth below, together with the accompanying drawings.

DESCRIPTION OF THE PREFERRED EMBODIMENTS

The first embodiment, in which the present invention is embodied in a compressor of variable displacement type, is described below with reference to FIG. 1 through FIG. 4. Carbon dioxide is used as refrigerant in the present invention.

Figure 1:
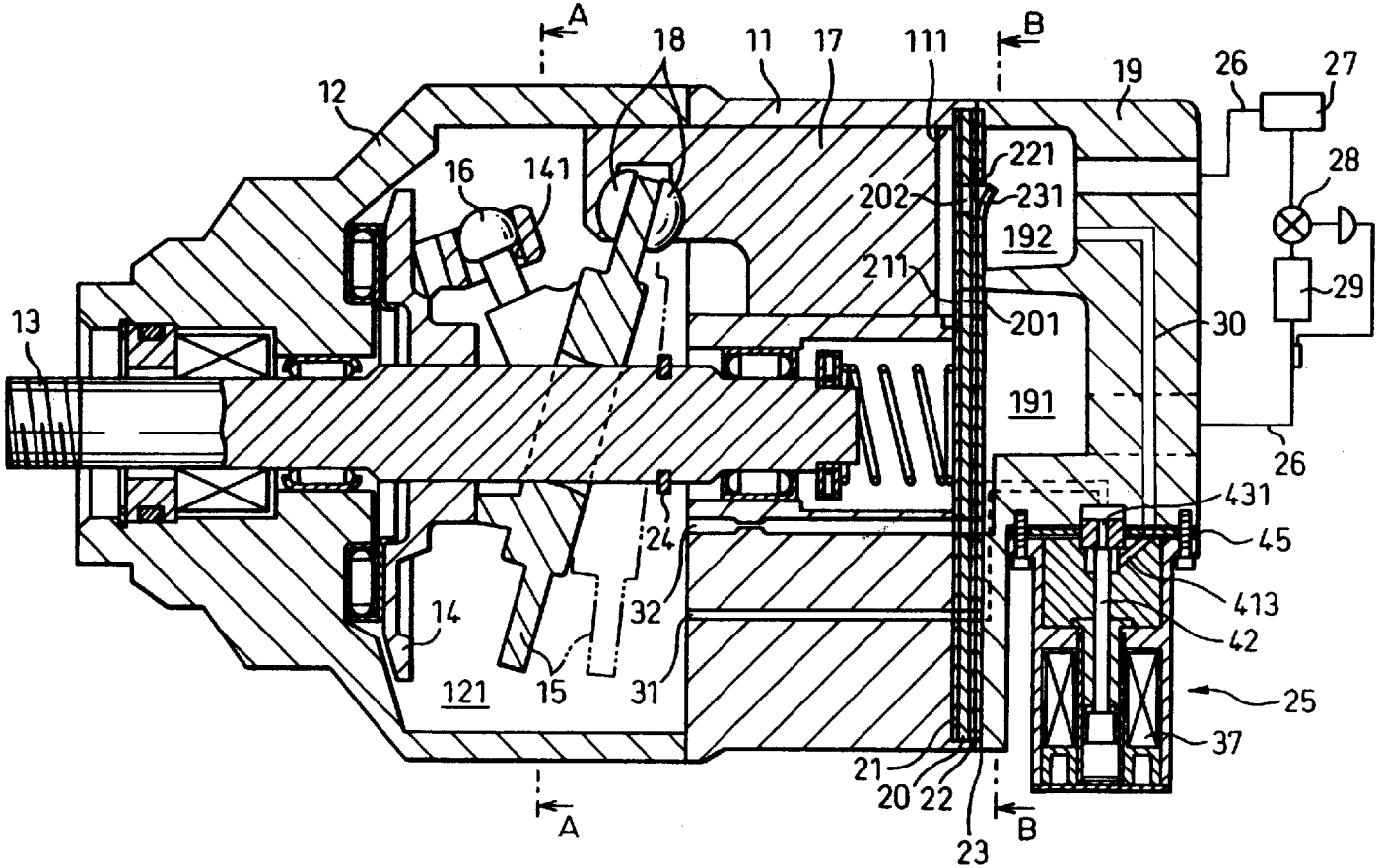
FIG. 1 is a profile cross-sectional view of the whole compressor in the first embodiment.
Figure 2:
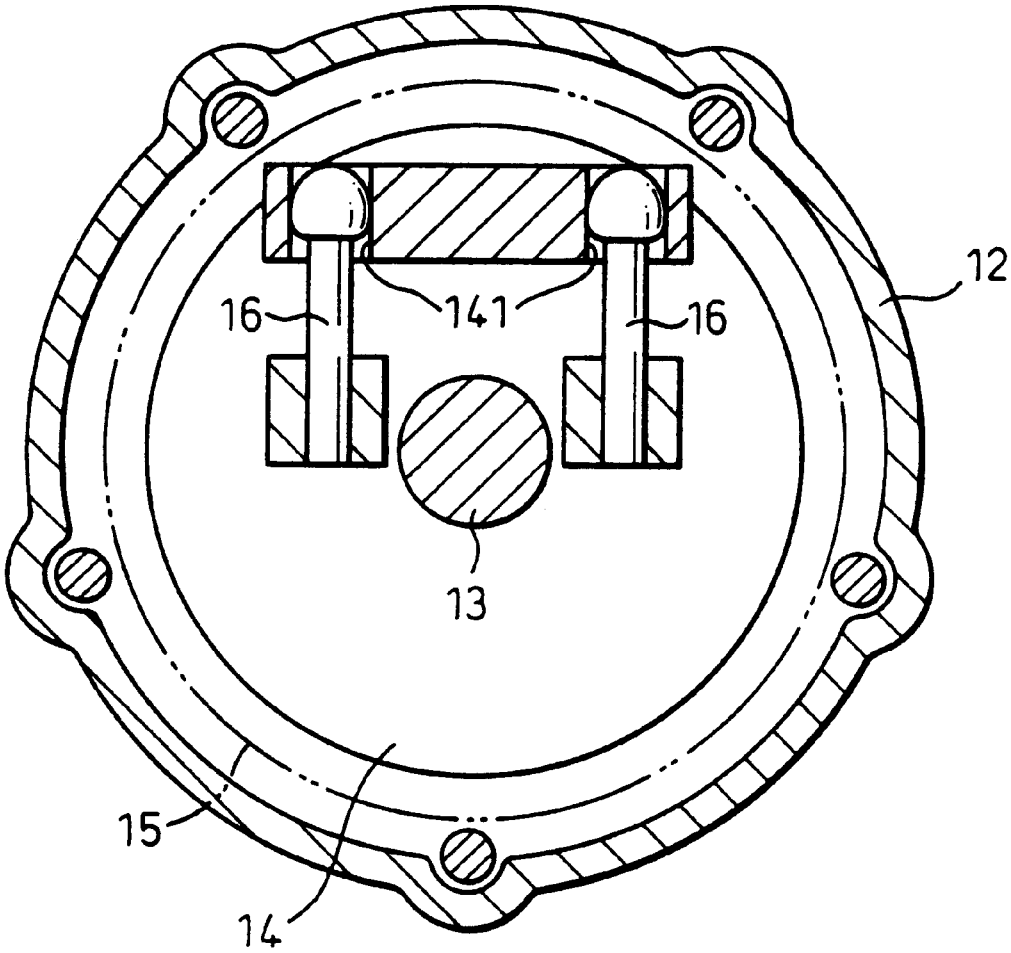
FIG. 2 is a section view taken along line A—A in FIG. 1.

As shown in FIG. 1, a rotating shaft 13 is supported by a cylinder block 11 and a front housing 12 that form a control pressure chamber 121. The rotating shaft 13 receives a rotational drive force from an external power source (a vehicle engine, for example). Not only is a rotary support 14 fixed to the rotating shaft 13 but, also, a swash plate 15 is supported by the rotating shaft 13 so that the swash plate can slide, move, and incline in the axial direction of the rotating shaft 13. As shown in FIG. 2, a pair of guide pins 16 is fixed to the swash plate 15. The guide pins 16 fixed to the swash plate 15 are slidably inserted into guide holes 141 formed on the rotary support 14. By engagement with the guide holes 141 and the guide pins 16, the swash plate 15 can move and incline in the axial direction of the rotating shaft 13 and rotate integrally with the rotating shaft 13. Inclination and movement of the swash plate 15 is guided by the relationship between the guide holes 141 and the guide pins 16, and the slide supporting action of the rotating shaft 13.

Figure 3:
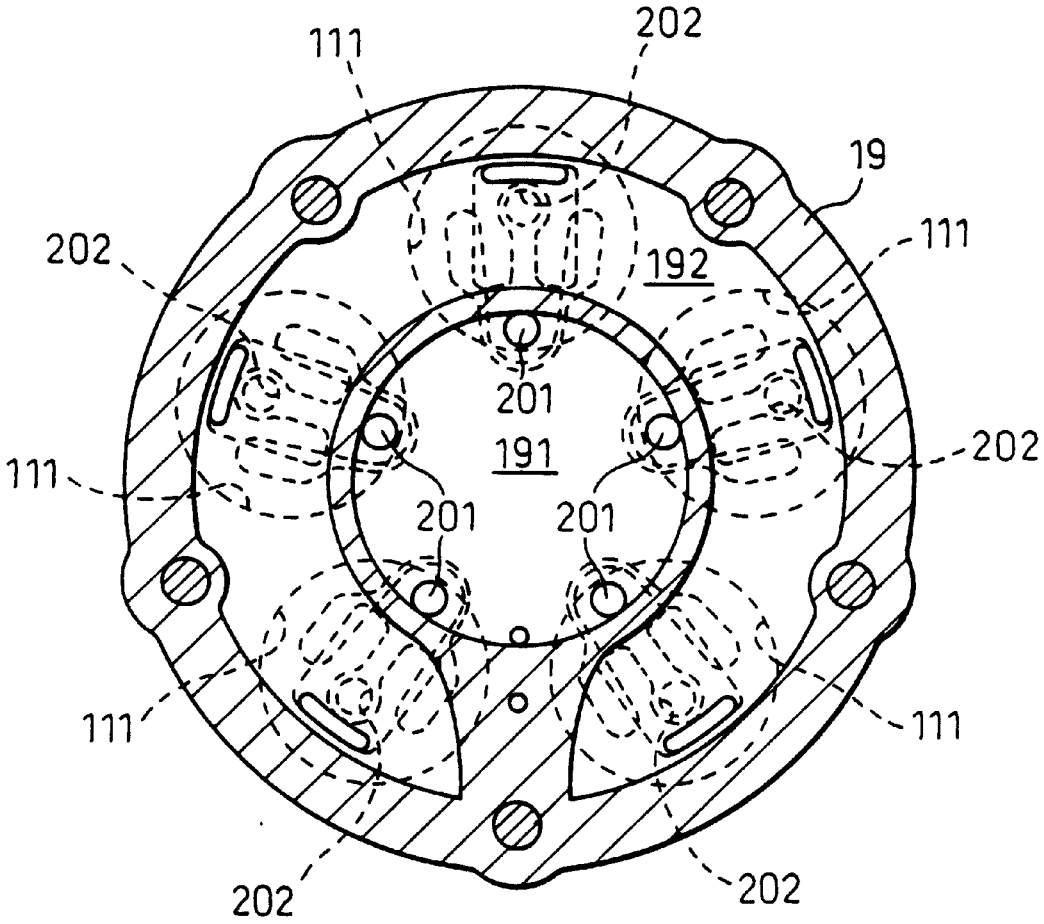
FIG. 3 is a section view taken along line B—B in FIG. 1.

As shown in FIG. 1, plural cylinder bores 111 (although only one is shown in FIG. 1, five are used in this embodiment as shown in FIG. 3) are arranged around the rotating shaft 13 in the cylinder block 11. A piston 17 is housed in each cylinder bore 111. The rotational motion of the swash plate 15, which rotates integrally with the rotating shaft 13, is converted into a reciprocating motion of the piston 17 via shoes 18, and the pistons 17 move back and forth in the cylinder bores 111.

A suction chamber 191 and a discharge chamber 192 are defined and formed in a rear housing 19. The refrigerant in the suction chamber 191, which is a suction pressure area, flows into the cylinder bore 111, after pushing back a suction valve 211 on a valve forming plate 21, from a suction port 201 on a valve plate 20, due to the reversing motion (movement from right to left in FIG. 1) of the piston 17. The refrigerant that flows into the cylinder bore 111 is discharged to the discharge chamber 192, which is a discharge pressure area, from a discharge port 202 on the valve plate 20, after pushing back a discharge valve 221 on a valve forming plate 22, due to the advancing motion (movement from left to right in FIG. 1) of the piston 17, which is the compression operating body. The discharge valve 221 comes into contact with a retainer 231 on a retainer forming plate 23, resulting in a restriction on the opening of the discharge valve 221.

Pressure supply passages 30 and 31, which connect the discharge chamber 192 and the control pressure chamber 121, pass the refrigerant in the discharge chamber 192 to the control pressure chamber 121. The refrigerant in the control pressure chamber 121 flows out into the suction chamber 191 through a pressure release passage 32 that connects the control pressure chamber 121 and the suction chamber 191. An electromagnetic displacement control valve 25 is interposed between the pressure supply passages 30 and 31.

The displacement control valve 25 is controlled by a controller (not shown), which controls the energization and deenergization of the displacement control valve 25 based on the passenger compartment temperature detected by a passenger compartment temperature detector (not shown), which detects the passenger compartment temperature in a vehicle, and the target passenger compartment temperature set by a passenger compartment temperature adjuster (not shown).

The inclination angle of the swash plate 15 is changed based on the pressure control in the control pressure chamber 121. When the pressure in the control pressure chamber 121 increases, the inclination angle of the swash plate 15 decreases, and when the pressure in the control pressure chamber 121 decreases, the inclination angle of the swash plate 15 increases. The supply of refrigerant from the discharge chamber 192 to the control pressure chamber 121 is controlled by the displacement control valve 25. When refrigerant is supplied from the discharge chamber 192 to the control pressure chamber 121, the pressure in the control pressure chamber 121 increases, and when the supply of refrigerant from the discharge chamber 192 to the control pressure chamber 121 is terminated, the pressure in the control pressure chamber 121 decreases. That is, the inclination angle of the swash plate 15 is controlled by the displacement control valve 25.

Figure 4:
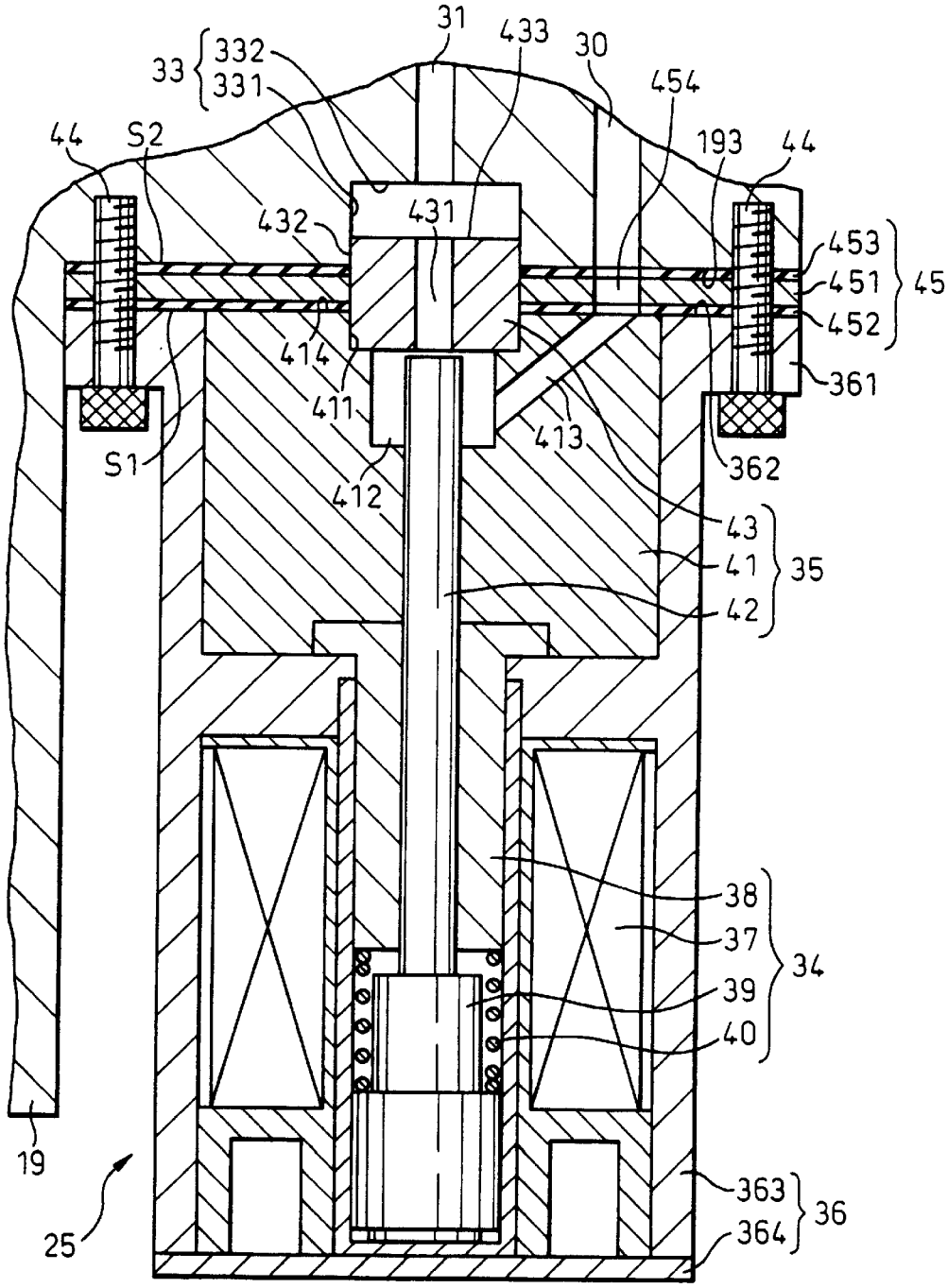
FIG. 4 is a profile cross-sectional view of the displacement control valve.

FIG. 4 shows the internal structure of the displacement control valve 25, that is, a gas flow control valve. The displacement control valve 25 comprises a solenoid portion 34 and a valve portion 35. The solenoid portion 34 comprises a coil 37 contained in a housing 36, a cylindrical fixed iron core 38, a cylindrical movable iron core 39, and a compression spring 40, which biases the movable iron core 39 in the direction so as to move away from the fixed iron core 38. When the coil 37 is energized with current, an electromagnetic force, which biases the movable iron core 39 to the fixed iron core 38 side, is generated. The valve portion 35 comprises a cylindrical guide body 41 fixed to the housing 36, a valve body 42 of rod shape penetrated through the guide body 41 and the fixed iron core 38, and connected and fixed to the movable iron core 39, and a cylindrical valve port forming body 43 fixed to the guide body 41.

An insertion recess 411 is recessed on an end surface 414 of the guide body 41 and the valve port forming body 43 is inserted into and fixed to the insertion recess 411. A gas chamber 412 is recessed at the bottom of the insertion recess 411, and the tip portion of the valve body 42 protrudes into the gas chamber 412. A gas passage 413 is formed in the guide body 41. The gas passage 413 runs from the end surface 414 of the guide body 41 to the gas chamber 412 through the inside of the guide body 41.

A valve port 431 is formed in the valve port forming body 43 so as to penetrate through the center of the cylindrical valve port forming body 43. The valve body 42 comes into contact with the end surface of the valve port forming body 43 when the coil 37 is energized with current, and is arranged at a valve-closing position to shield the valve port 431 from the gas chamber 412. The valve body 42 is moved away from the end surface of the valve port forming body 43 by the spring force of the compression spring 40 in a state where the coil 37 is not energized with current, and is arranged at a valve-opening position to connect the valve port 431 and the gas chamber 412.

The housing 36 comprises a cylindrical portion 363 and a lid portion 364 fixed closely to the end portion of the cylindrical portion 363, and the coupling portion between the cylindrical portion 363 and the lid portion 364 is sealed.

The displacement control valve 25 is installed onto a suitable coupling surface 193 on the outer wall surface of the rear housing 19 by tightening screws 44. On the coupling surface 193, an insertion recess 33 is arranged and the valve port forming body 43 is inserted into the insertion recess 33 in a situation where the displacement control valve 25 is installed to the coupling surface 193. When the valve port forming body 43 is inserted into the insertion recess 33, the valve port 431 is communicated with the insertion recess 33. A coupling flange 361 is formed on the circumferential surface of the end portion of the housing 36 of the displacement control valve 25, and an end surface 362 of the coupling flange 361 and the end surface 414 of the guide body 41 are arranged so that both are on the same plane.

Between the end surfaces 362, 414 and the coupling surface 193, a ring shaped gasket 45 is interposed so as to surround the valve port forming body 43. The gasket 45 comprises a metal substrate 451 and rubber sealing elastic layers 452 and 453, which are baked onto both surfaces of the substrate 451. The sealing elastic layer 452 is in close contact with the end surfaces 362 and 414, and the sealing elastic layer 453 is in close contact with the coupling surface 193.

A communication port 454 is installed in the gasket 45 so as to penetrate the sealing elastic layers 452 and 453, and the pressure supply passage 30 and the gas passage 413 are communicated with each other through the communication port 454. The pressure supply passage 31 is communicated with the insertion recess 33. When the valve body 42 is at a valve-opening position, the pressure supply passage 30 and the pressure supply passage 31 are communicated with each other through the communication port 454, the gas passage 413, the gas chamber 412, the valve port 431, and the insertion recess 33, and the refrigerant in the discharge chamber 192 is sent to the control pressure chambers 121.

As shown in FIG. 1, the maximum inclination angle of the swash plate 15 is defined when the swash plate 15 comes into contact with the rotary support 14. The minimum inclination angle of the swash plate 15 is defined when a circlip 24 on the rotating shaft 13 comes into contact with the swash plate 15.

The discharge chamber 192 and the suction chamber 191 are connected via an external refrigerant circuit 26. The refrigerant, which flows out from the discharge chamber 192 into the external refrigerant circuit 26, is fed back to the suction chamber 191 via a condenser 27, an expansion valve 28, and an evaporator 29.

The following effects can be obtained in the first embodiment.

(1-1)

A first gas passage L1 (the symbol is omitted in the figure), comprising the pressure supply passage 30, the communication port 454, the gas passage 413, and the gas chamber 412, is penetrated through the gasket 45. Therefore, the sealing elastic layer 452 of the gasket 45 prevents the refrigerant in the first gas passage L1 from leaking out of the compressor along the end surfaces 362 and 414. Moreover, the sealing elastic layer 453 of the gasket 45 prevents the refrigerant in the first gas passage L1 from leaking out of the compressor along the coupling surface 193.

The first gas passage L1, comprising the pressure supply passage 30, the communication port 454, the gas passage 413, and the gas chamber 412, is communicated with the discharge chamber 192, and a second gas passage L2 (the symbol is omitted in the figure), comprising the pressure supply passage 31, the insertion recess 33, and the valve port 431, is communicated with the control pressure chamber 121. Therefore, the pressure in the first gas passage L1 is higher than that in the second gas passage L2. The sealing elastic layer 452 prevents the refrigerant in the first gas passage L1 of a higher pressure from flowing into the second gas passage L2 of a lower pressure along the end surface 414 and a circumferential surface 432 of the valve port forming body 43. The sealing elastic layer 453 prevents the refrigerant in the first gas passage L1 from flowing into the second gas passage L2 along the coupling surface 193 and the circumferential surface 432 of the valve port forming body 43. Moreover, the sealing elastic layer 452 prevents the refrigerant in the second gas passage L2 from leaking out of the compressor along the end surfaces 362 and 414, and the sealing elastic layer 453 prevents the refrigerant in the second gas passage L2 from leaking out of the compressor along the coupling surface 193.

A surface S1 (shown in FIG. 4) of the sealing elastic layer 452, which in close contact with the end surfaces 362 and 414, and a surface S2 (shown in FIG. 4) of the sealing elastic layer 453, which is in close contact with the coupling surface 193, are seal operating portions of the gasket 45. The end surfaces 362 and 414, the circumferential surface 432 of the valve port forming body 43, and an end surface 433 of the valve port forming body 43 are installing surfaces of the displacement control valve 25. The installing surfaces of the displacement control valve oppose (face) the rear housing 19, that is, a gas passage forming body. The coupling surface 193, a circumferential surface 331 of the insertion recess 33, and a bottom surface 332 of the insertion recess 33 are installing surfaces, opposing the displacement control valve 25, of the rear housing 19. The installing surfaces of the rear housing 19 oppose (face) the displacement control valve 25. The first gas passage L1 and the second gas passage L2 penetrate through each of the opposing installing surfaces in the surrounded area on each of the installation opposing surfaces surrounded by the seal operating portions S1 and S2 of the gasket 45. Moreover, the first gas passage L1 penetrates through the seal operating portions S1 and S2 of the gasket 45. In such a structure, into which the first gas passage L1 and the second gas passage L2 penetrate, the prevention of communications between the first gas passage L1 and the outside of the compressor, between the second gas passage L2 and the outside of the compressor, and between the first gas passage L1 and the second gas passage L2 can be achieved by only the single gasket 45.

(1-2)

The surfaces of the sealing elastic layers 452 and 453, which are the seal operating portions S1 and S2 of the gasket 45 are planes. The entire surface of the plane of the sealing elastic layer 452 can be pressed by pressure and comes into contact with the planes of the end surfaces 362 and 414, and the entire surface of the plane of the sealing elastic layer 453 can be pressed by pressure and comes into contact with the plane of the coupling surface 193. The coupling between planes has advantages in equalizing the pressure-pressed contact at arbitrary points on the plane, and sealing by the gasket 45 on the planes of the end surfaces 362 and 414, and the coupling surface 193 has advantages in improving the reliability of the sealing operation. Moreover, damage to the sealing elastic member due to the foaming phenomenon can be suppressed.

(1-3)

For example, when the outer circumferential surface of a column and the inner circumferential surface of a cylinder are pressed by the pressure and made to come into contact with each other for coupling, the portions where the outer circumferential surface of the column and the inner circumferential surface of the cylinder are pressed by pressure and come into contact are limited to only part of the circumferential surface in the circumferential direction. That is, it is impossible for the entire outer circumferential surface of the column and the entire inner circumferential surface of the cylinder to be uniformly pressed by the pressure and come into contact with each other. Therefore, when a ring shaped seal member is interposed between the outer circumferential surface of the column and the inner circumferential surface of the cylinder, it is necessary to elastically transform a thick rubber seal member into a thin one and generate a uniform sealing operation over the entire circumferential surface in the circumferential direction. Employing a thick seal member increases the quantity of the refrigerant of carbon dioxide that permeates the seal member and the damages of the seal member due to the foaming phenomenon.

Because the entire surface of the plane of the sealing elastic layer 452 can be uniformly pressed by pressure and comes into contact with the planes of the end surfaces 362 and 414, the thickness of the sealing elastic layer 452 can be reduced. Moreover, because the entire surface of the plane of the sealing elastic layer 453 can be uniformly pressed by pressure and comes into contact with the plane of the coupling surface 193, the thickness of the sealing elastic layer 453 can also be reduced. Therefore, the quantity of the carbon dioxide refrigerant that permeates the sealing elastic layers 452 and 453 is small and damage to the sealing elastic layers 452 and 453 due to the foaming phenomenon is avoided.

(1-4)

The gasket 45 is formed by baking the sealing elastic layers 452 and 453, which are sealing elastic members, on both sides of the substrate 451. The thickness of the baked sealing elastic layers 452 and 453 can be reduced and therefore the quantity of the high-pressure carbon dioxide refrigerant that permeates the sealing elastic layers 452 and 453 is small. Therefore, damage to the sealing elastic layers 452 and 453, due to the foaming phenomenon, is avoided.

Figure 5:
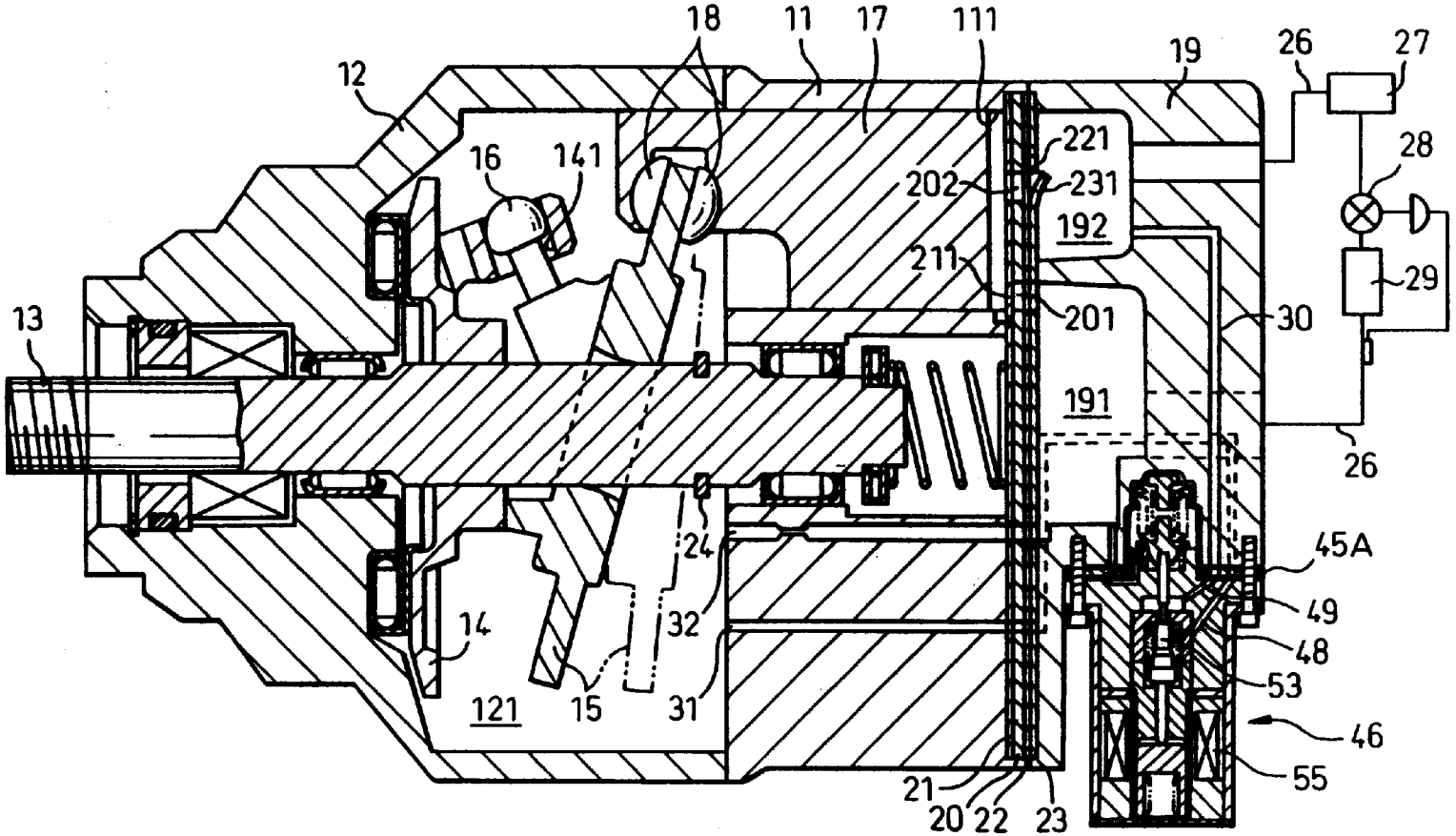
FIG. 5 is a profile cross-sectional view of the whole compressor in the second embodiment.
Figure 6:
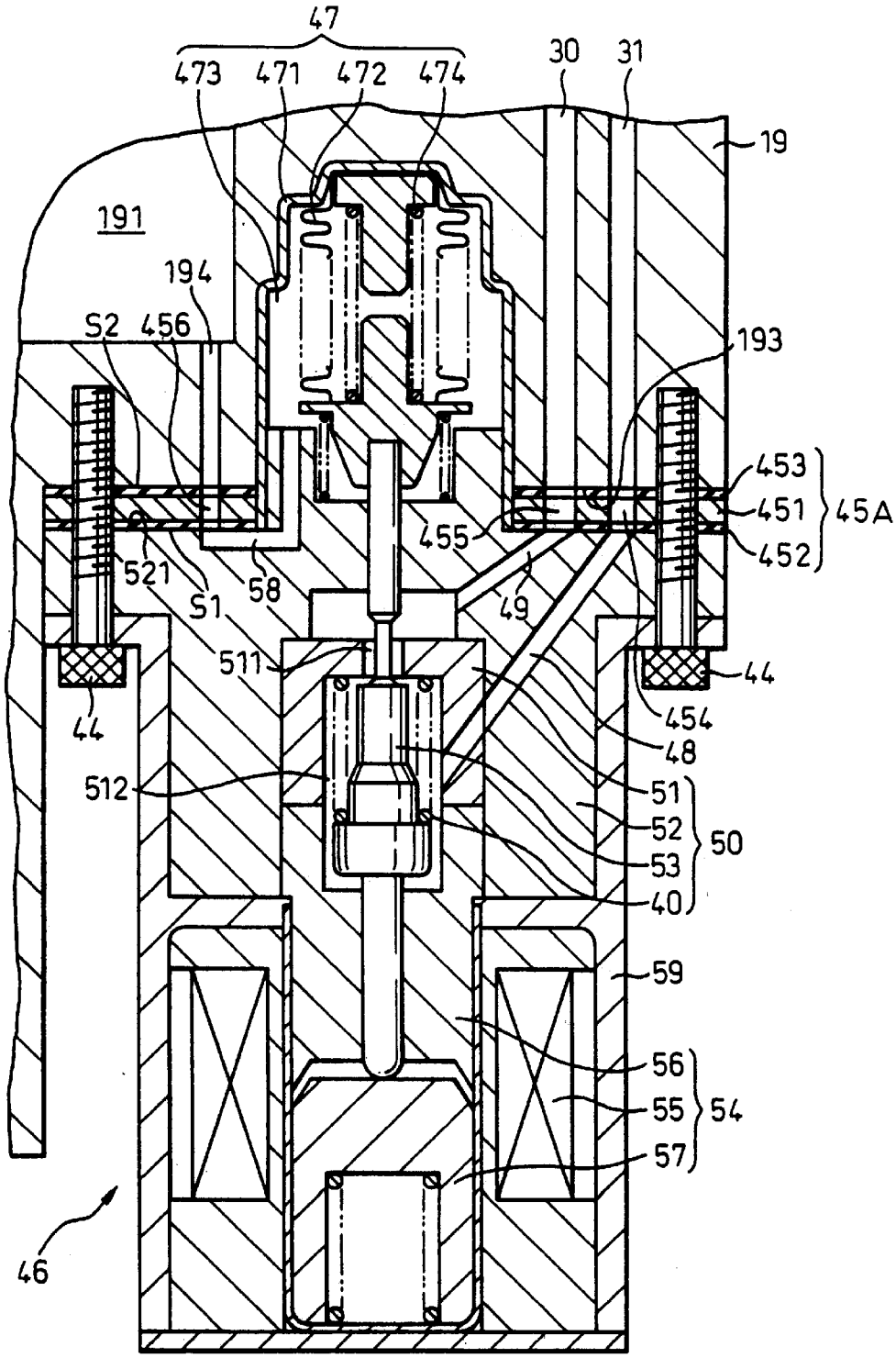
FIG. 6 is a profile cross-sectional view of the displacement control valve.

Next the second embodiment in FIGS. 5 and 6 is described below. The same symbols are attached to the same components as in the first embodiment.

A valve portion 50 contained in a housing 59 of a displacement control valve 46 comprises a valve port forming body 51, a passage forming body 52, a valve body 53, and the compression spring 40. An end surface 521 of the passage forming body 52 is opposing the coupling surface 193 of the rear housing 19 via a gasket 45A. The end surface 521 is the opposing installing surface of the displacement control valve 46.

A valve port 511 is formed in the valve port forming body 51 and the valve body 53 contained in a housing chamber 512 in the valve port forming body 51 opens and closes the valve port 511. A gas passage 48 is formed in the valve port forming body 51 and the passage forming body 52 so as to communicate with the housing chamber 512. A gas passage 49 is formed in the passage forming body 52 so as to communicate with the valve port 511. The gas passage 48 communicates with the pressure supply passage 30 via the communication port 454 formed in the gasket 45A. The gas passage 49 communicates with the pressure supply passage 31 via a communication port 455 formed in the gasket 45A. Moreover, a pressure sensitive passage 58 is formed in the passage forming body 52. The pressure sensitive passage 58 communicates with the suction chamber 191 via a communication port 456 formed in the gasket 45A and a gas passage 194 formed in the rear housing 19.

A solenoid portion 54 of the displacement control valve 46 comprises a coil 55, a fixed iron core 56, and a movable iron core 57, and the valve body 53 penetrates through the fixed iron core 56 and comes into contact with the movable iron core 57. When the coil 55 is energized with current, the valve body 53 is biased in the direction so that the valve body 53 closes the valve port 511 by overcoming the spring force of the compression spring 40. When the coil 55 is not energized with current, the valve body 53 is arranged at the valve-opening position so that the valve port 511 is opened to the maximum.

A pressure sensitive means 47 is built in the displacement control valve 46. The pressure sensitive means 47 comprises a pressure sensitive housing 471, a bellows 472, a pressure sensitive chamber 473 defined in the pressure sensitive housing 471 by the bellows 472, and a pressure sensitive spring 474 contained in the bellows 472.

The gas pressure of the refrigerant in the suction chamber 191 acts on the bellows 472 via the gas passage 194, the communication port 456, the pressure sensitive passage 58, and the pressure sensitive chamber 473. The valve body 53 is connected to the bellows 472 and the valve body 53 opens and closes the valve port 511. The spring force of the pressure sensitive spring 474 acts on the valve body 53 in a direction so as to open the valve port 511. The electromagnetic drive force of the coil 55 of the displacement control valve 46 biases the valve body 53 in the direction so as to close the valve port 511. The displacement control valve 46 controls the supply of a suction pressure according to the value of the current supplied to the coil 55. The coil 55 receives the excitation and demagnetization control of the controller (not shown), and the controller controls the excitation and demagnetization of the displacement control valve 46 based on the temperature detected by the passenger compartment temperature detector (not shown) that detects the passenger compartment temperature in the vehicle and based on the target passenger compartment temperature set by the passenger compartment temperature adjuster (not shown).

When the valve port 511 of the displacement control valve 46 is open, the refrigerant in the discharge chamber 192 is sent to the control pressure chamber 121 via the valve port 511 and the pressure supply passages 30 and 31. When the value of the electric current supplied to the coil 55 is raised, the opening of the valve decreases, and the flow rate of the refrigerant supplied from the discharge chamber 192 to the control pressure chamber 121 decreases. Because the refrigerant in the control pressure chamber 121 flows out into the suction chamber 191 through the pressure release passage 32, the pressure in the control pressure chamber 121 drops. Therefore, the inclination angle of the swash plate 15 increases and the discharge displacement increases. The increase in the discharge displacement causes the suction pressure to drop. When the value of the supplied electric current is lowered, the opening of the valve increases and the flow rate of refrigerant supplied from the discharge chamber 192 to the control chamber 121 increases. Therefore, the pressure in the control pressure chamber 121 is raised, the inclination angle of the swash plate 15 decreases and the discharge displacement decreases. The decrease of the discharge displacement causes the suction pressure to increase.

The relative position of the valve body 53 with respect to the valve port 511, that is, the opening of the valve, is influenced by the gas pressure of the refrigerant in the suction chamber 191. The gas pressure of the refrigerant in the suction chamber 191 reflects the thermal load. The larger the thermal load is, that is, the higher the gas pressure of the refrigerant in the suction chamber 191 is, the larger the contraction, due to the gas pressure, the bellows 472 suffers. In other words, as the thermal load becomes larger, the valve body 53 moves in the direction so as to close the valve port 511, and the opening of the valve decreases. Therefore, the inclination angle of the swash plate 15 increases because the flow rate of refrigerant supplied from the discharge chamber 192 to the control pressure chamber 121 decreases, and the discharge displacement increases. The increase in the discharge displacement causes the thermal load to decrease. On the contrary, as the thermal load becomes smaller, the valve body 53 moves in the direction so as to open the valve port 511 and the opening of the valve increases. Therefore, the inclination angle of the swash plate 15 decreases because the flow rate of refrigerant supplied from the discharge chamber 192 to the control pressure chamber 121 increases, and the discharge displacement decreases. The decrease of the discharge displacement causes the thermal load to increase.

The gasket 45A, which is interposed between the displacement control valve 46 that carries out the displacement control as mentioned above and the rear housing 19, carries out the same function as that of the gasket 45 in the first embodiment. Moreover, the gasket 45A prevents the refrigerant from leaking out of the compressor from the pressure sensitive passage 58 and leaking from the pressure supply passages 30 and 31 to the pressure sensitive passage 58 and a passage 194.

Figure 7:
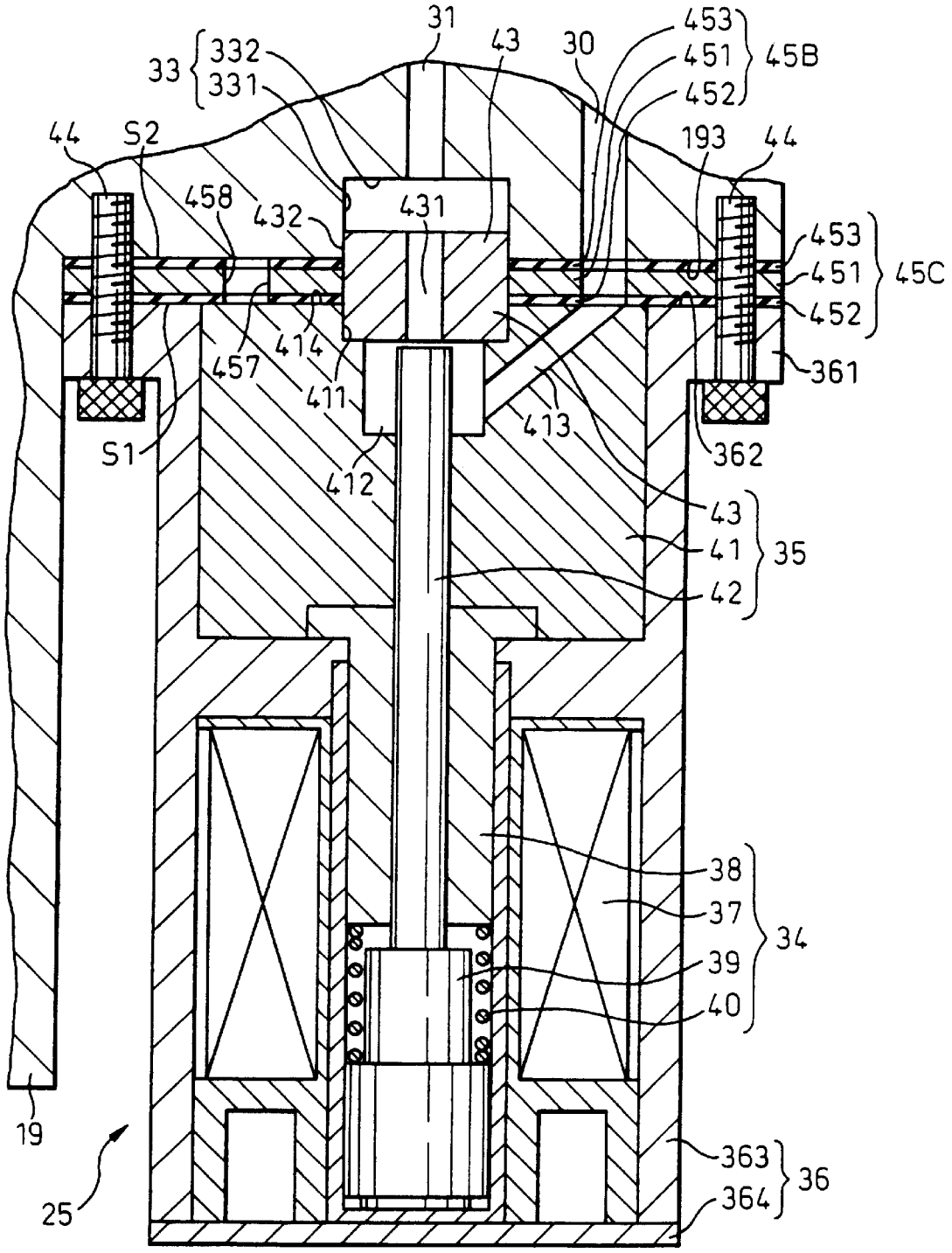
FIG. 7 is a profile cross-sectional view of the displacement control valve in the third embodiment.

Next, the third embodiment in FIG. 7 will be described. The same symbols are attached to the same components as those in the first embodiment.

In this embodiment, a gasket 45B that has a small diameter and a ring shape, and a gasket 45C that has a large diameter and a ring shape are used. The diameter of an outer circumferential edge 457 of the gasket 45B is made smaller than that of an inner circumferential edge 458 of the gasket 45C, and the pressure supply passage 30 and the gas passage 413 are communicated by the space between the outer circumferential edge 457 of the gasket 45B and the inner circumferential edge 458 of the gasket 45C.

In the present invention, the following embodiments can be realized.

(1) Seal members made of only sealing elastic materials are used.

(2) Seal members made of only sealing elastic materials are fixed to the opposing installing surfaces of the gas flow control valve side.

(3) Seal members made of only sealing elastic materials are fixed to the opposing installing surfaces of the main body side of the compressor.

(4) The present invention is applied to a compressor of a variable displacement type, in which a displacement control valve is interposed on the pressure release passage 32 so that the movement of the refrigerant from the control pressure chamber 121 to the suction chamber 191 is controlled thereby.

(5) The present invention is applied to a gas flow control valve (that is, a relief valve), which allows part of the refrigerant in the discharge pressure area to escape to the suction pressure area when the pressure in the discharge pressure area becomes abnormally high.

As described in detail above, the present invention can be expected to bring an excellent effect in that the number of seal members can be reduced because the first gas passage and the second gas passage are made to penetrate through each opposing installing surface in the surrounded area on each opposing installing surface surrounded by the seal operating portions of the seal members, and at least either the first gas passage or the second gas passage is made to penetrate through the seal operating portions of the seal members.

The present invention, in which the seal operating portions of the seal members are plane, will bring about an excellent effect in that an abnormal gas flow due to damage to the seal members relating to the gas flow control valve can be prevented.

While the invention has been described by reference to specific embodiments chosen for the purpose of illustration, it should be apparent that numerous modifications could be made thereto by those skilled in the art without departing from the basic concept and scope of the invention.

What is claimed is:

1. A gas passage structure in a compressor in which a compression operating body is moved by the rotation of a rotating shaft, a gas flow control valve that controls the gas flow in gas passages in the compressor that compresses and discharges the gas by means of the action of the compression operating body, is provided and the gas flow control valve is attached to the main body of the compressor so as to oppose a gas passage forming body that forms the gas passage, wherein:

a seal means that is formed by one seal member or plural seal members is interposed between an installing surface an the gas passage forming body side, and an installing surface on the gas flow control valve side that opposes the gas passage forming body;

a first gas passage, of the gas passages that passes within the gas passage forming body and the gas flow control valve is connected to an inner valve port of the gas flow control valve;

a second gas passage, of the gas passages, that passes within the gas passage forming body and the gas flow control valve is connected to a second valve port of the gas flow control valve so that the second gas passage is communicated with the first gas passage via the second valve port;

the first gas passage and the second gas passage penetrate through each of the opposing installing surfaces in a surrounded area on each of the opposing installing surfaces surrounded by a seal operating portion of the seal member or plural seal members; and at least either the first gas passage or the second gas passage penetrates through the seal operating portion of the seal member or plural seal members.

2. A gas passage structure in a compressor, as set forth in claim 1, wherein the seal means comprises plural seal members one of which has a small diameter and a ring shape and another of which has a large diameter and a ring shape, and a gas passage is formed between the inner circumferential edge of the large diameter ring-shaped seal member and the outer circumferential edge of the small diameter ring-shaped seal member.

3. A gas passage structure in a compressor, as set forth in claim 1, wherein the seal operating portions of the seal member or the plural seal members on each of the opposing installing surfaces are planar.

4. A gas passage structure in a compressor, as set forth in claim 1, wherein the seal member is a gasket comprising a substrate, to both surfaces of which sealing elastic materials are fixed.

5. A gas passage structure in a compressor, as set forth in claim 1;

wherein the compressor is a compressor of a variable displacement type, which comprises a swash plate contained in a control pressure chamber so that integral rotation with the rotating shaft is allowed and the inclination angle thereof with respect to the rotating shaft can be varied, and plural pistons, which are arranged around the rotating shaft and perform reciprocating motion in accordance with the inclination angle of the swash plate, and in which gas is supplied from a discharge pressure area to the control pressure chamber via a pressure supply passage, gas is released from the control pressure chamber to a suction pressure area via a pressure release passage to control the pressure in the control pressure chamber, the inclination angle of the swash plate is increased by pressure drop in the control pressure chamber and the inclination angle of the swash plate is decreased by a pressure increase in the control pressure chamber; and wherein the gas flow control valve controls the gas flow in the pressure supply passage or the gas flow in the pressure release passage.

* * * * *